US005515767A

United States Patent [19]

Gilbert

[11] Patent Number: 5,515,767

[45] Date of Patent: May 14, 1996

[54] DEVICE FOR FIRING A PROJECTILE

[75] Inventor: Robert J. Gilbert, North Lopham, England

[73] Assignee: Richmond Electronic and Engineering International Limited, Norfolk, England

[21] Appl. No.: 30,206

[22] PCT Filed: Sep. 18, 1991

[86] PCT No.: PCT/GB91/01597

§ 371 Date: Mar. 17, 1994

§ 102(e) Date: Mar. 17, 1994

[87] PCT Pub. No.: WO92/05396

PCT Pub. Date: Apr. 2, 1992

[30] Foreign Application Priority Data

Sep. 18, 1990 [GB] United Kingdom ..... 9020378

[51] Int. Cl.[6] ..... F41A 1/08

[52] U.S. Cl. ..... 89/1.701; 86/50

[58] Field of Search ..... 89/1.701, 1.7, 89/1.13; 86/50

[56] References Cited

U.S. PATENT DOCUMENTS

| | | | |
|---|---|---|---|
| 3,026,775 | 3/1962 | Musser | 89/1.7 |
| 3,724,372 | 4/1973 | Phillips | 86/50 |
| 3,779,130 | 12/1973 | Schnabele | 89/1.701 |
| 3,815,469 | 6/1974 | Schubert et al. | 89/1.701 |
| 4,046,055 | 9/1977 | McDanolds et al. | 86/50 |
| 4,132,148 | 1/1979 | Meistring et al. | 89/1.701 |
| 4,169,403 | 10/1979 | Hanson | 86/50 |
| 4,957,027 | 8/1990 | Cherry | 89/1.14 |
| 5,099,764 | 3/1992 | Dale et al. | 102/374 |
| 5,136,920 | 8/1992 | Breed et al. | 86/50 |
| 5,337,648 | 8/1994 | Brage | 89/1.704 |

FOREIGN PATENT DOCUMENTS

| | | | |
|---|---|---|---|
| 578595 | 6/1959 | Canada | 89/1.7 |
| 2638828 | 5/1990 | France | 86/50 |
| 2083894 | 3/1982 | United Kingdom | 89/14.3 |
| 2230846 | 10/1990 | United Kingdom | 89/1.7 |

*Primary Examiner*—Charles T. Jordan
*Assistant Examiner*—Christopher K. Montgomery
*Attorney, Agent, or Firm*—Lee, Mann, Smith, McWilliams, Sweeney & Ohlson

[57] ABSTRACT

A device for firing a projectile for de-arming purposes, comprises a barrel for housing a projectile and an explosive charge. A sleeve surrounds the barrel, so as to define an annular chamber accommodating solid or liquid recoil absorbing material. Radial ports interconnect the barrel and the annular chamber so that when the projectile is fired the annular chamber is pressurized and the recoil absorbing material is expelled rearwardly from the chamber, so as to counteract recoil.

12 Claims, 2 Drawing Sheets

DEVICE FOR FIRING A PROJECTILE

FIELD OF THE INVENTION

The invention relates to a device for firing a projectile. It will be seen that, although described in relation to a device for use in de-arming, for example an explosive device, the invention includes within its scope devices for use in other applications, and is not limited to de-arming devices.

BACKGROUND TO THE INVENTION

Conventional de-arming devices operate by firing a solid projectile at an explosive device so as to disrupt the fuse mechanism of the explosive device, ideally without detonating the explosive device. Such a de-arming device comprises a barrel, the breech of which contains an explosive charge, such as a conventional gun cartridge which, when detonated, propels a projectile, also initially contained in the barrel, towards the target.

Although these de-arming devices are operated by remote control, problems can still arise from the mechanical reaction caused by firing the projectile. Such a reaction can cause the barrel to recoil with a momentum sufficient to endanger people or equipment in the vicintiy of the de-arming device. A known way of solving this problem is to fit the de-arming device with a retro-active rocket comprising a second barrel which is opposed to the first barrel, and which is used to fire a second gun cartridge in synchronism with the firing of the first cartridge. The gases ejected as a result of firing the second cartridge disperse relatively rapidly and consequently are less likely to cause damage, than a recoiling barrel.

This arrangement, whilst being effective as a means of countering recoil, is expensive, and takes a long time to be primed for firing.

An alternative approach is to fit the end of the barrel with rearward-facing Venturi ports through which, in use, expanding gases produced by the exploding cartridge of the de-arming device escape. This arrangement is similar to the anti-recoil systems used on conventional artillery guns. The arrangement is less cumbersome than the retro-rocket, but is generally less effective at counteracting recoil.

It is accordingly an object of the invention to provide a device for firing a projectile which device includes a simple but effective means for counteracting recoil.

It is a further object of the invention to provide a relatively compact means for counteracting re-coil in such a device.

SUMMARY OF THE INVENTION

According to the invention there is provided a device for firing a projectile, the device comprising a barrel for housing the projectile and an explosive charge for propelling the projectile; a sleeve so mounted on the barrel as to surround at least part of the latter and to define a chamber for containing solid or liquid recoil absorbing material; and one or more ports through which the chamber communicates with the barrel, the chamber having a rear outlet through which the material, in use, is ejected so as to counteract the recoil caused by firing the projectile, the material being expelled from the chamber through the outlet as a result of the explosion caused by the detonation of the charge.

The expanding gases caused by detonation of the charge impart a relatively large momentum to the recoil absorbing material, thus providing an effective means of counteracting recoil in the device. Furthermore, the device is relatively simple and the use of a sleeve to surround part of the barrel leads to a compact construction of the device.

Preferably the cross sectional or shape of the sleeve corresponds to that of the part of the outer surface of the barrel which is contained within the former, in which case, the sleeve and barrel may with advantage be coaxial.

The sleeve is preferably of a circular cross section, the chamber thus being annular.

The device may with advantage include closure means which, with the chamber loaded with material, serves to seal the outlet.

The closure means may take the form of a frangible seal which ruptures to allow material to be ejected from the chamber, but preferably comprises a closure cap which is a close-fit over the outlet.

In addition, the chamber preferably includes a piston interposed between the recoil absorbing material and the or each port.

The piston inhibits or prevents material from the chamber entering the barrel through any port before the device is fired.

The breech of the barrel may be situated within the sleeve, but preferably projects as far as or beyond one end of the sleeve such that there is defined a passage through the outlet via which passage the exposive charge in the barrel may be accessed in order to be detonated.

The material may be water, sand or any other material which disperses in a sufficiently short distance to avoid causing an undue hazard to people and equipment in the vicinity of the device.

The device may be provided with attachments for connection to the barrel. For example, there may be provided a barrel extension comprising a tube which is, in use, attached to the end of the barrel downstream of the explosive charge, and which contains a charge of water constituting the projectile.

In addition, there may be provided a choke comprising a nozzle for attachment to the end of the barrel extension so as to reduce the velocity at which the charge of water is fired at a target.

Such a nozzle may be used if, for example, the device is used to de-arm a sensitive fuse which may be triggered by the impact of water travelling at too high a velocity.

Alternatively, the end of the barrel extension may be attached to a hollow housing in which a nozzle is slidably mounted, the nozzle being attached to a blade which may project beyond the end of the housing, the blade and nozzle being prevented from leaving the open end of the housing by a stop, the arrangment being such that, in use, the charge of water passing through the nozzle propels the nozzle, and hence the blade, towards a target.

This attachment can be used where a fuse which is to be disarmed is protected by, for example, a casing which would not be penetrated by water alone. In such a case, blade serves to penetrate the casing, enabling the water to strike the fuse, but is prevented from entering the device by the stop.

The nozzle of this sort of attachment is preferably spaced from the housing so as to define an intermediate chamber, and includes a port via which water passing through the nozzle may enter the chamber so as to cushion the impact of the nozzle with the stop.

BRIEF DESCRIPTION OF THE DRAWINGS

The invention will now be described, by way of example only, with reference to the accompanying drawings in which.

DETAILED DESCRIPTION

Figures 1, 2:
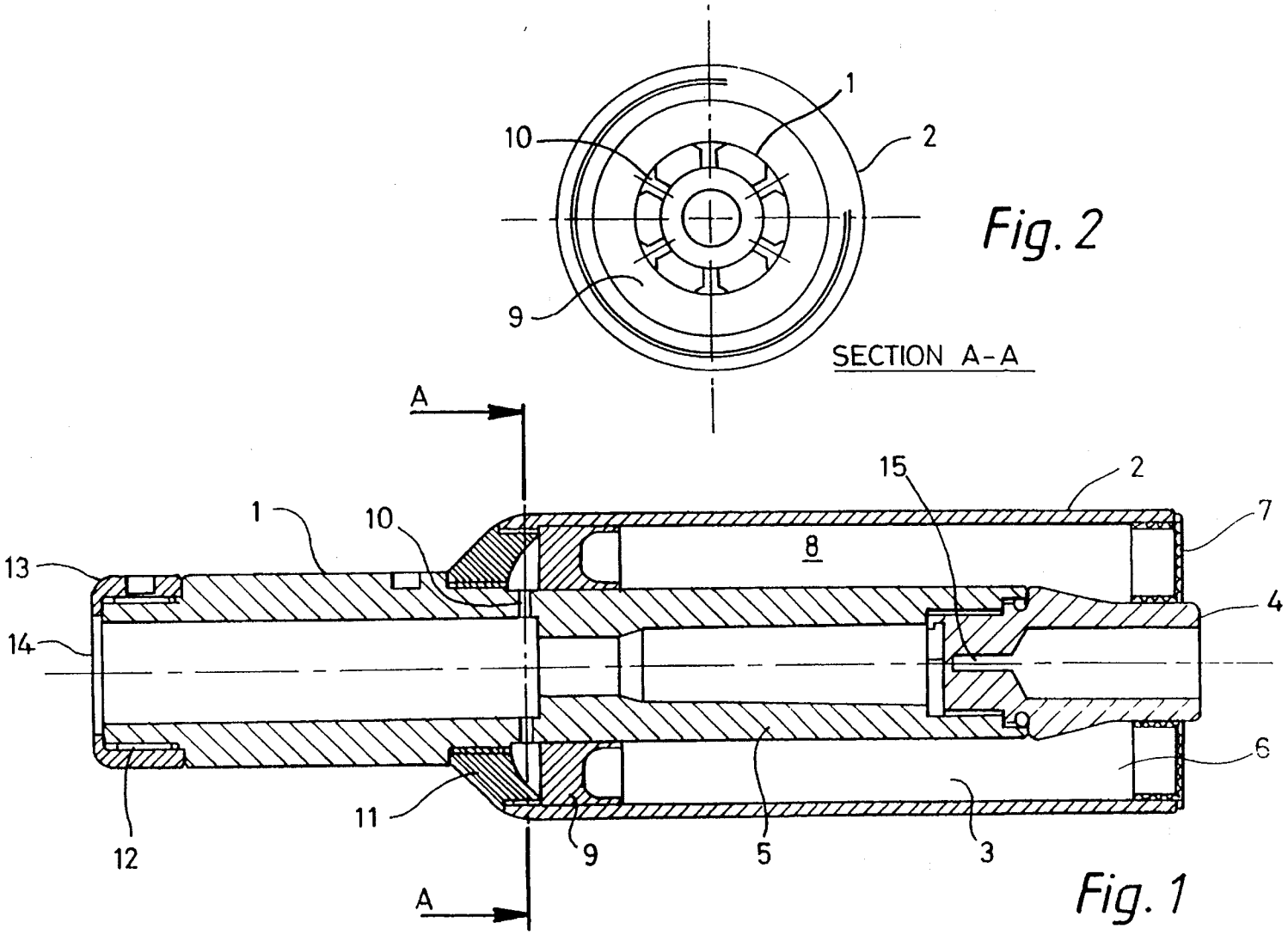
FIG. 1 is a sectional side view of a device according to the invention.
FIG. 2 is a section taken along the line A—A of FIG. 1.

Referring to FIG. 1, the device comprises a barrel 1 on which a sleeve 2 is mounted so as to define an annular chamber 3 between the sleeve 2 and the barrel 1.

The barrel 1 includes a breech plug 4 which is detachably connected to the end of a breech portion 5 of the rest of the barrel 1 by means of a screw-threaded connection. The breech plug 4 also includes a passage 15 through which, in use, two flying leads (not shown) pass. The flying leads are attached to an explosive charge in the form of a cartridge (not shown) in the breech portion 5 and are used to relay the electrical power needed to detonate the cartridge.

The breech plug 4 and sleeve 2 define an annular outlet 6 at the rear of the chamber 3, which outlet is sealed by an annular closure cap 7. The forward end of the chamber 3 is closed by an annular piston 9 slidably mounted therein. The annular volume of the chamber 1 between the closure cap 7 and the piston 9 is filled with recoil absorbing material 8.

The piston 9 separates the material 8 from six equally circumferentially spaced radial ports 10 through which the chamber 3 can communicate with the interior of the barrel 1.

The forward end of the chamber 3 is terminated by an annular collar 11 attached to the barrel 1 and the sleeve 2.

The front end of the barrel 1 includes a screw-threaded connector 12 which enables the device to be connected to various attachments and which, when not in use, is protected by a barrel protector cap 13 having a central aperture 14.

When the device is to be fired, it is set up a distance of the order of 35 mm from the target, a device to be de-armed. A gun cartridge is loaded into the barrel 1, through the rear of the breech portion 5, with the plug 4 removed, and the plug 4 is then attached to the breech portion 5 to retain the cartridge in positon. A suitable projectile (not shown) is then loaded into the device through the front of the barrel 1 such that the trailing edge of the projectile abuts the breech portion 5, and is thus at a position just upstream of the ports 10. The cartridge is then remotely detonated, propelling the projectile out of the barrel through the aperture 14. As the trailing edge of the projectile passes the ports 10, expanding gases produced by the detonation of the cartridge pass through the ports 10 and into the chamber 3, the pressure thus exerted in the chamber 3 causing the piston 9 to move towards the outlet 6. This in turn causes the closure cap 7 and the material 8 to be ejected rearwardly, so as to counteract the recoil produced by firing the device.

Figure 3:
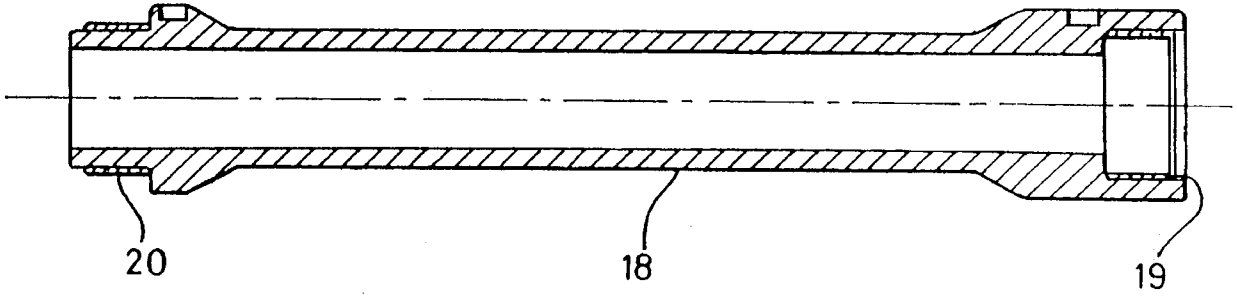
FIGS. 3, 4 and 5 show various attachments for use with the device.

An extension tube 18 (FIG. 3) may be connected to the front end of the barrel 1 by means of the screw-threaded connector 12 which cooperates with a correspondingly screw-threaded portion 19 in the extension tube 18.

The barrel is loaded with a projectile and the extension tube 18 is filled with water which is retained therein by means of frangible washers or seals (not shown). Thus, in this case, the firing of the device ejects a single pulse of water from the extension tube 18, followed by the projectile. When the projectile clears the ports 10, the expanding gases produced by the detonation of the cartridge push the piston 9 rearwardly, so as to eject the cap 7 and the material 8, in order to counteract recoil, as previously described. The extension tube 18 has a screw-threaded end 20 onto which the cap 13 may be screwed, in order to protect the tube 18 when it is not in use.

Figure 4:
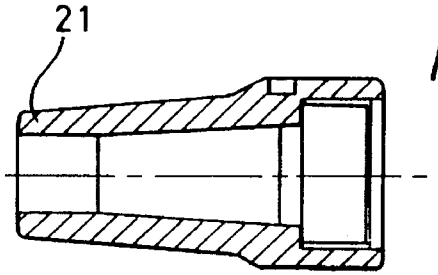
Figure 5:
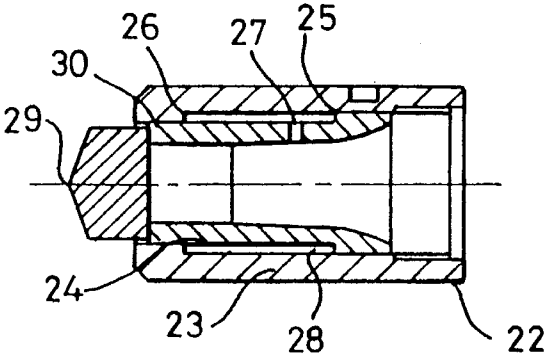

The screw-threaded end 20 enables the extension tube 18 to be connected to further accessories such as a nozzle 21 (FIG. 4) which serves to reduce the speed at which water is ejected from the device, or to an alternative attachment 22 as shown in FIG. 5.

The attachment 22 comprises a housing 23 in which a nozzle 24 is slidably mounted. The nozzle 24 includes an outward facing shoulder 25 which, in use, cooperates with a corresponding shoulder 26 in the housing 23 to act as a stop for preventing the nozzle 24 from leaving the end of the housing 23. The nozzle 24 also includes a radial port 27 which leads into an intermediate chamber 28 defined between the nozzle 24 and casing 23.

The end of the nozzle 24 is attached to a blade 29, and is sealed against the housing 23 by means of an 0 ring seal 30.

Upon firing the device, water passes through the nozzle 24, causing the latter to slide along the housing 23 the direction of the flow of water until the shoulder 25 engages the shoulder 26. The impact of the shoulders 25 and 26 is cushioned by water which escapes into the chamber 28 through the port 27. The blade 29 pierces the casing of the target to allow the water to strike a fuse which would otherwise be protected by the casing, but the interengagement of the shoulders 25 and 26 limits forward movement of the blade 29 and prevents the latter striking the fuse.

It will be appreciated that the projectile is of a shape and size to suit the explosive device to be de-armed. Where the explosive device is covered by a comparatively soft skin (such as a vehicle door or a suitcase), it is preferable to use a pulse of water (from the extension tube 18) to pierce the skin, before the pulse of water and the following projectile effect de-arming. The device is then said to be a de-armer disrupter, the term disrupter being used when a pulse of high velocity water is projected at the target.

The provision of an annular space for accommodating the material 8 means that the force countering recoil is symmetrical and balanced. The annular body of material 8 which is ejected from the rear of the device breaks up comparatively quickly, so the lethal area at the rear of the device is comparatively small. The device is also quick to re-load ready for a subsequent firing.

I claim:

1. A device for firing a projectile, the device comprising a barrel for housing the projectile and an explosive charge for propelling the projectile; a sleeve so mounted on the barrel as to surround at least part of the barrel, that part of the barrel and the sleeve defining a chamber for containing a recoil absorbing material which comprises either one of a solid and a fluid, the chamber surrounding at least part of the barrel; the device further comprising at least one port through which the chamber communicates with the barrel, the chamber having a rear outlet through which, in use, said recoil absorbing material is ejected so as to counteract the recoil caused by firing the projectile, said recoil absorbing material being expelled from the chamber through the outlet as a result of an explosion cause by detonation of the change.

2. A device according to claim 1, wherein the cross sectional shape of the sleeve corresponds to that of the part of the outer surface of the barrel which is contained within the sleeve.

3. A device according to claim 1, wherein the sleeve and barrel are coaxial.

4. A device according to claim 3, wherein the sleeve is of a circular cross section, the chamber thus being annular.

5. A device according claim 1, wherein closure means serves to seal the outlet, the closure means being expelled from the outlet on detonation of the charge.

6. A device according to claim 5, wherein the closure means takes the form of a frangible seal which ruptures to allow material to be ejected from the chamber.

7. A device according to claim 5, wherein the closure means comprises a closure cap which is a close fit over the outlet.

8. A device according to claim 1, wherein the chamber includes a piston interposed between the recoil absorbing material and said port.

9. A device according to claim 1, wherein a barrel extension tube is attachable to the forward end of the barrel, to contain a charge of water constituting the projectile.

10. A device according to claim 9, wherein a nozzle is provided for attachment to the forward end of the barrel extension so as to reduce the velocity at which the charge of water is fired at a target.

11. A device according to claim 9, wherein a hollow housing is attachable to the forward end of the extension tube, a nozzle being slidable in the housing and being attached to a blade at the forward end of the housing, the blade and nozzle being prevented from leaving the open end of the housing by a stop, the arrangment being such that, in use, the charge of water passing through the nozzle propels the nozzle, and hence the blade, towards a target, with the stop limiting forward movement of the blade.

12. A device according to claim 11, wherein an intermediate chamber is formed between the housing and the nozzle, a port allowing water passing through the nozzle to enter the intermediate chamber so as to cushion the impact of the nozzle against the stop.

* * * * *